US008608264B2

(12) United States Patent
Wing

(10) Patent No.: US 8,608,264 B2
(45) Date of Patent: Dec. 17, 2013

(54) REFRIGERATOR RAIL SYSTEM FOR REMOVABLY SUPPORTED SIDE-SLIDING SHELVES

(75) Inventor: Forrest F. Wing, Des Moines, IA (US)

(73) Assignee: Whirlpool Corporation, Benton Harbor, MI (US)

( * ) Notice: Subject to any disclaimer, the term of this patent is extended or adjusted under 35 U.S.C. 154(b) by 2179 days.

(21) Appl. No.: 11/412,832

(22) Filed: Apr. 28, 2006

(65) Prior Publication Data

US 2007/0252498 A1 Nov. 1, 2007

(51) Int. Cl.
*A47B 96/04* (2006.01)

(52) U.S. Cl.
USPC ..... 312/408

(58) Field of Classification Search
USPC ..... 312/404, 408; 108/107, 108, 152; 211/103, 90.01, 90.02, 88.01, 187, 211/153, 190, 191, 193, 207; 248/222.51, 248/222.52, 220.21
See application file for complete search history.

(56) References Cited

U.S. PATENT DOCUMENTS 3,794,183 A * 2/1974 Colbridge ..... 211/208
3,833,090 A * 9/1974 Georgianna ..... 182/92
4,129,395 A * 12/1978 Theurer et al. ..... 403/317
4,444,323 A * 4/1984 Travis ..... 211/193
4,809,941 A * 3/1989 Sheridan ..... 248/249
5,167,332 A 12/1992 Schröter
5,362,145 A 11/1994 Bird et al.
5,403,083 A * 4/1995 Dasher et al. ..... 312/408
5,429,433 A 7/1995 Bird et al.
5,454,638 A 10/1995 Bird et al.
5,524,981 A 6/1996 Herrmann et al.
5,540,493 A 7/1996 Kane et al.
5,564,809 A 10/1996 Kane et al.
6,223,916 B1 * 5/2001 Enos ..... 211/187
6,269,906 B1 * 8/2001 Dockter et al. ..... 182/92
2003/0020387 A1 * 1/2003 Wing et al. ..... 312/408

FOREIGN PATENT DOCUMENTS

JP 2001050647 2/2001

* cited by examiner

*Primary Examiner* — Matthew Ing

(57) ABSTRACT

A repositionable rail system for a refrigerator includes first and second rails, each rail having a plurality of spaced-apart apertures. A crossbar has first and second ends adapted to fit within respective apertures on the first and second rails. After inserting the crossbar into the apertures, the crossbar is rotated to a fixed angled position. A half-width shelf having a hook is adapted to removably supported, in a cantilevered manner, by the crossbar. The half-width shelf can be slid along the crossbar for repositioning within the refrigerator cabinet, or may be placed alongside another half-width shelf on a crossbar, or replaced with a full width shelf mounted on the first and second rails in a corresponding, cantilevered manner.

16 Claims, 4 Drawing Sheets

REFRIGERATOR RAIL SYSTEM FOR REMOVABLY SUPPORTED SIDE-SLIDING SHELVES

BACKGROUND OF THE INVENTION

1. Field of the Invention

The present invention pertains to the art of refrigerator shelving systems and, more specifically, to a refrigerator rail system for removably supporting side-sliding refrigerator shelves.

2. Discussion of the Prior Art

Many different types of shelving systems have been provided for refrigerator compartments. For example, it is common to provide vertically adjustable storage units and/or shelves in refrigerator cabinets in order to increase the versatility of storing a wide range of food items. To this end, many fresh food compartments have elongated, vertically extending and laterally spaced rails or tracks mounted on rear walls thereof, with the rails enabling storage units to be supported in selected vertically adjustable positions in a cantilevered manner. Typical rails of this type include a plurality of spaced slots into which storage unit hooks can be inserted to support the units in a cantilevered fashion. In some instances, storage units lack the requisite hooks such that adapters, which can themselves hook into the rails, are used to support the storage units. One example of this type of storage unit can be seen in U.S. Application Publication No. 2003/0020387 which discloses half-width shelves supported in a cantilevered fashion on a vertically adjustable hooked bracket assembly. Half-width shelves of this type can be selectively positioned in either a side-by-side manner or vertically spaced from one another, thereby permitting a consumer to customize the inside of a refrigerator cabinet and allow enhanced space utilization and access to stored food items.

Of course, in cases where the typical rail and hook configuration is not utilized, other configurations would need to be provided to produce an easily customized shelving configuration for a refrigerator cabinet. As with all rail systems for shelving units, the materials used and the design of the individual pieces of the system can greatly affect the ease of assembly and cost of production. Therefore, there exists a need in the art for a simple and economical adjustable rail system that allows shelves to be slid to a desired horizontal position or adjusted vertically for easy customization of the inside of a refrigerator compartment.

SUMMARY OF THE INVENTION

The present invention is directed to a refrigerator shelving system for removably supporting side-sliding refrigerator shelves. The rail system includes first and second horizontally spaced rails positioned adjacent the back wall of a refrigerator compartment. Each rail includes a plurality of spaced-apart apertures formed therein for removably retaining a crossbar. A first end of the crossbar is inserted into an aperture in the first rail, while a second end of the crossbar is inserted into an aperture in the second rail. The crossbar can then be rotated within the apertures to a fixed, angled position with respect to the rails. Once the crossbar is fixed to the rails, a shelf, having at least one hook, can be mounted onto the crossbar so that the shelf extends from and is supported by the crossbar in a cantilevered fashion. When the shelf has a width that is less than that of the crossbar, the hook of the shelf can be slid along the crossbar to re-position the shelf horizontally within the refrigerator cabinet. Thus, this system allows one or more refrigerator shelves to be positioned in various horizontal and/or vertical positions within a refrigerator for easy customization of the inside of the refrigerator compartment.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
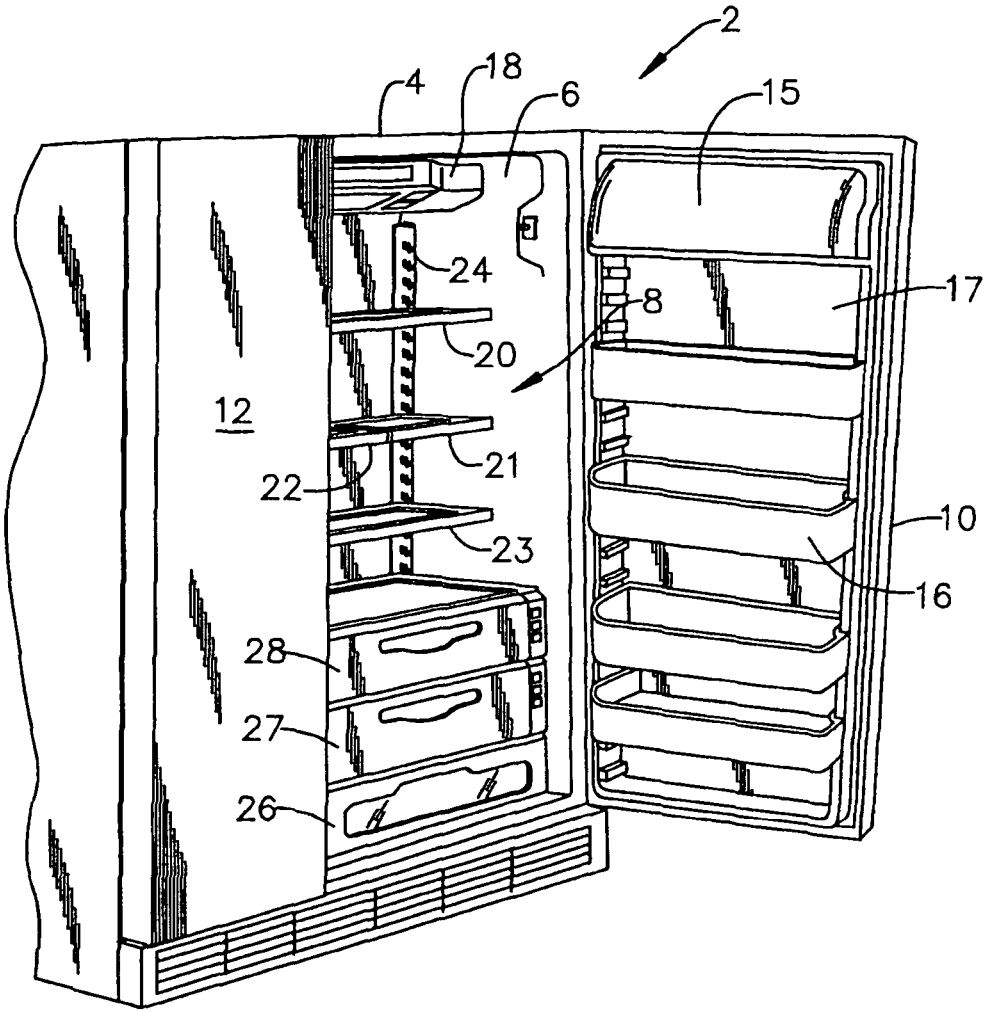
FIG. 1 is a perspective view of a refrigerator including the rail system of the present invention.

With initial reference to FIG. 1, a refrigerator cabinet 2 includes a cabinet shell 4 within which is positioned a liner 6 that defines a fresh food compartment 8. In a manner known in the art, fresh food compartment 8 can be accessed by the selective opening of a fresh food door 10. In a similar manner, a freezer door 12 can be opened to access a liner defined freezer compartment (not shown). For the sake of completeness, door 10 of refrigerator cabinet 2 is shown to include a dairy compartment 15 and various vertically adjustable storage units, one of which is indicated at 16. As shown, storage unit 16 constitutes a pick-off bucket that can be selectively removed from a liner 17 of door 10. Mounted in an upper region of fresh food compartment 8 is a temperature control housing 18 which, in a manner known in the art, can be used to regulate the temperature in both fresh food compartment 8 and the freezer compartment. Below temperature control housing 18 are arranged a plurality of vertically spaced shelves 20-23 which are preferably mounted for selective vertical adjustment upon rear rails, one of which is indicated at 24. At a lowermost portion of fresh food compartment 8 are illustrated various slidable bins, i.e., a lowermost bin 26 and higher, individually temperature controlled bins 27 and 28.

Figure 2:
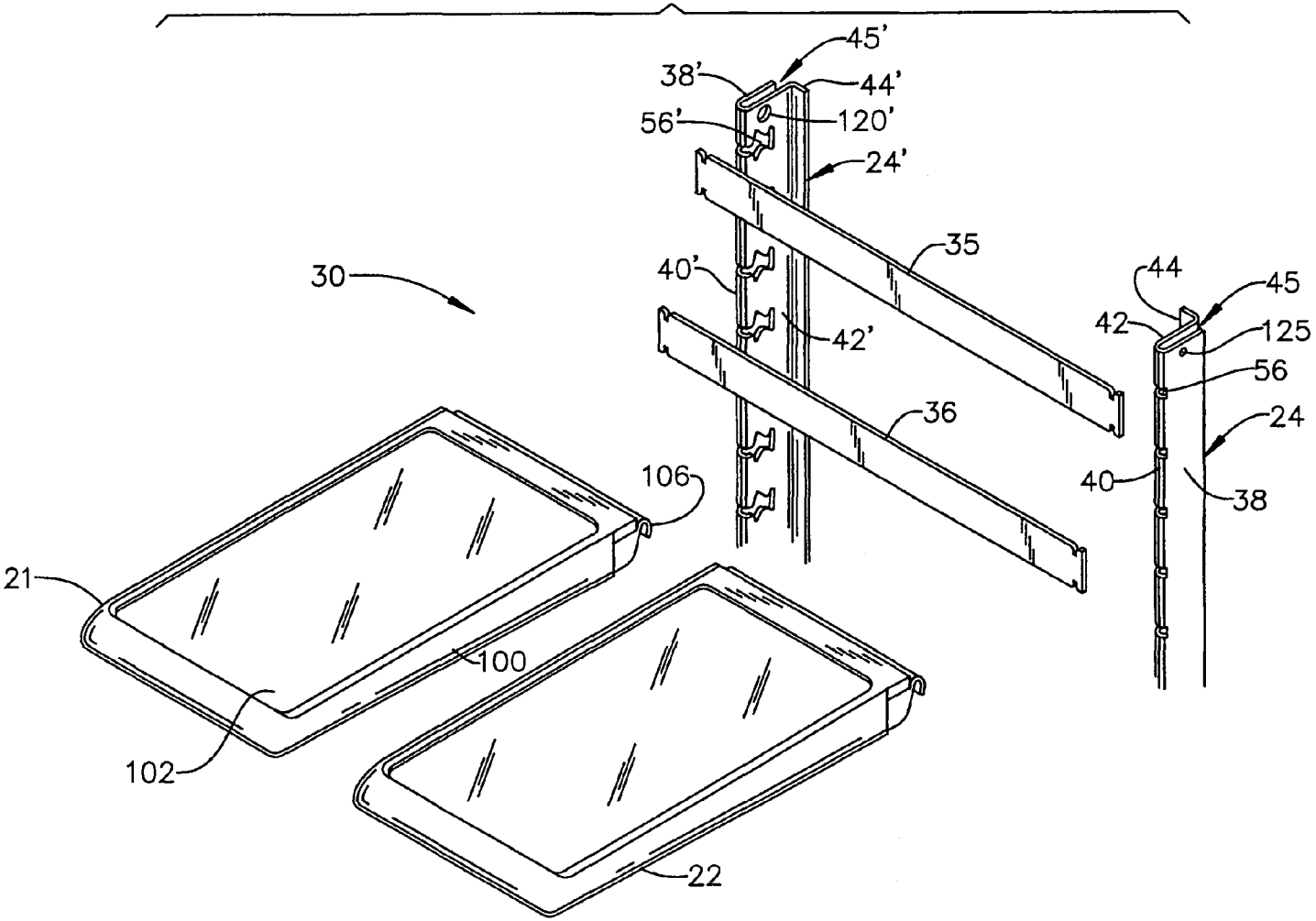
FIG. 2 is an exploded perspective view of the rail system of FIG. 1.

The present invention is actually directed to a rail system 30, including rear rail 24, for side-sliding refrigerator shelves. As shown in FIG. 2, rail system 30 of the present invention includes support rails 24 and 24', crossbars 35 and 36, and half-width shelves 21 and 22. Although two crossbars 35, 36 and two shelves 21, 22 are shown for illustrative purposes, system 30 could, of course, include any desirable number of crossbars and shelves. As rail 24' is a mirror image of rail 24, only rail 24 will be discussed in detail and it is understood that rail 24' is constructed in the same manner.

In a preferred embodiment, rail 24 is formed from an elongated metal sheet that has been folded longitudinally back on itself. In this manner a rail 24 is produced having a mounting portion 38 that transitions at a bent portion 40 to a crossbar support portion 42 that is substantially parallel to mounting portion 38. Additionally, a lip portion 44 extends substantially perpendicular from crossbar support portion 42. A channel 45 is established between and defined by mounting portion 38 and crossbar support portion 42. Like rail 24, rail 24' is produced having a mounting portion 38' that transitions at a bent portion 40' to a substantially parallel crossbar support portion 42' and a lip portion 44' extending substantially perpendicular from the mounting portion 38'. A channel 45' is located between and defined by mounting portion 38' and crossbar support portion 42'. Crossbar support portions 42 and 42' include a plurality of spaced apart apertures 56 and 56' respectively. A crossbar 35, 36 is inserted in selected apertures 56, 56' and retained and supported within rails 24 and 24' in a manner further described below. However, at this point, it should be understood that rails 24 and 24' are mounted to refrigerator compartment side walls through mounting portions 38, 38' as also further discussed below.

Figure 3:
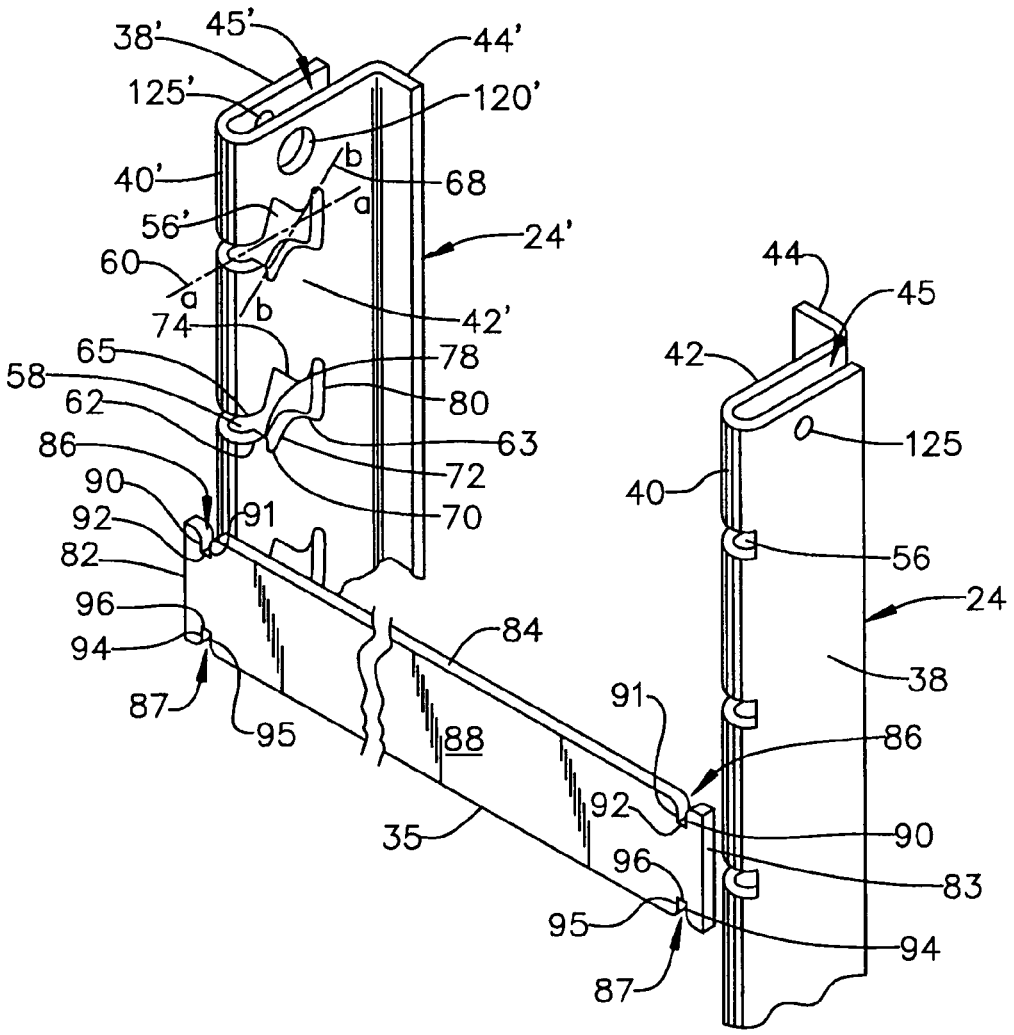
FIG. 3 is a close-up partial view of the rail system of FIG. 2.

As can be seen in FIG. 3, the peripheral structure around each aperture 56' partially defines an opening 58 of a first slot 60 that is aligned along an axis a-a. This peripheral structure includes a first bottom wall portion 62, a second bottom wall portion 63 and a top wall portion 65. A second slot 68 is aligned along an axis b-b and intersects first slot 60 at an acute angle. Second slot 68 is partially defined by peripheral structure of aperture 56', including a bottom end wall 70, an angled sidewall 72 and a top shoulder 74. Additionally, second slot 68 is partially defined by a bottom shoulder portion 78 which extends between bottom end wall 70 of second slot 68 and first bottom wall portion 62 of first slot 60. First and second slots 60 and 68 share a common curved end wall 80.

Crossbar 35 is preferably a one-piece flat metal bar having a first end 82, a second end 83 and a connecting portion 84 between the first and second ends 82 and 83. First and second ends 82 and 83 have respective first and second notches 86 and 87. Each first notch 86 is defined by sidewalls 90 and 91 and an end wall 92. Likewise, each second notch 87 is defined by sidewalls 94 and 95 and an end wall 96. Connecting portion 84 includes a support face 88 and a back face (not shown).

Figure 4:
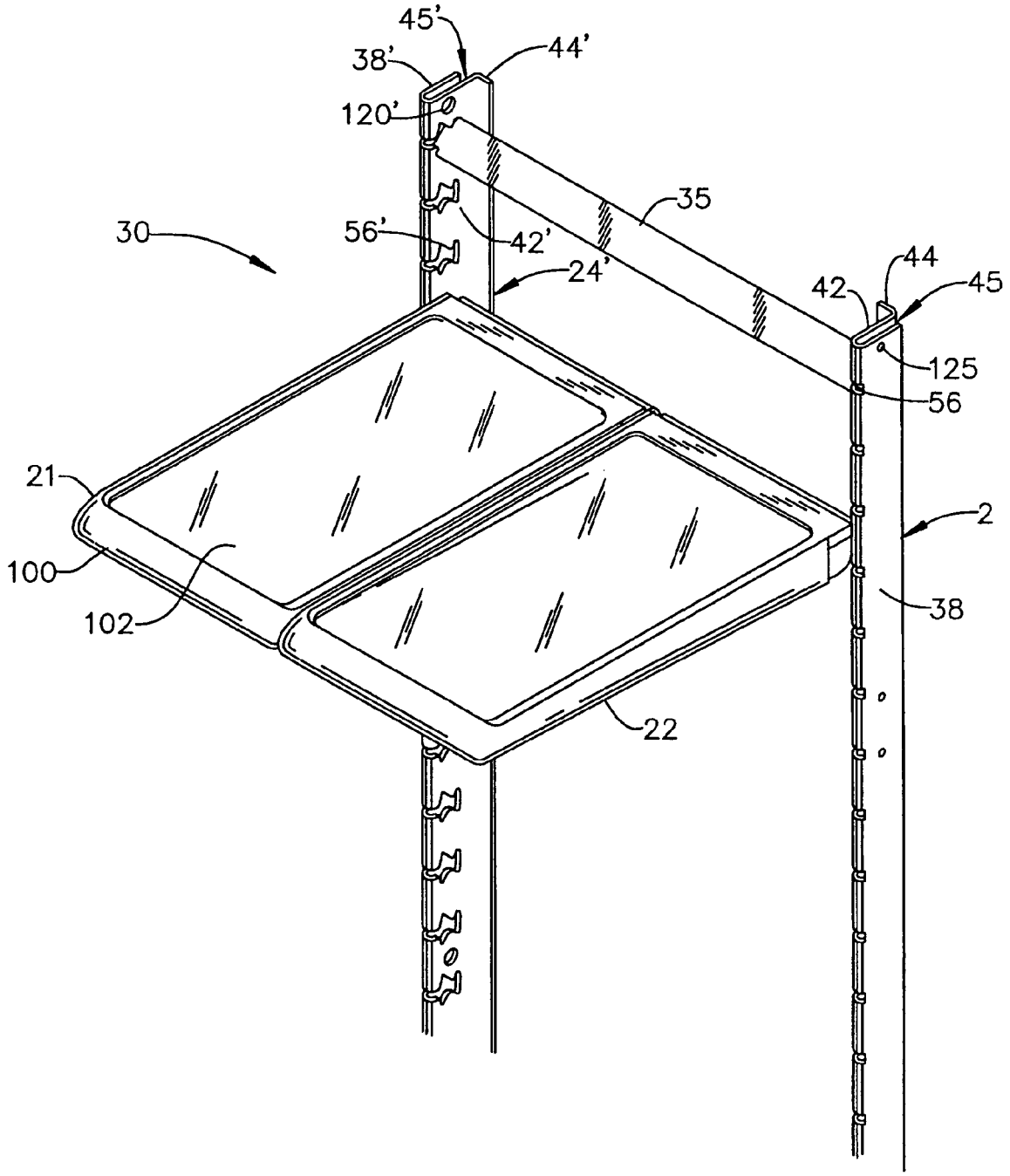
FIG. 4 is a perspective view of the fully assembled rail system of FIG. 2.

FIGS. 3 and 4 will now be referenced for the manner in which crossbar 35 is inserted and retained in support rails 32 and 33. A user first selects a set of apertures 56, 56' on rails 24, 24' that correspond to a desired shelf height in refrigerator cabinet 2. The user then inserts respective ends of crossbar 35 into select apertures 56, 56' in rails 24, 24'. As both ends 82, 83 of crossbar 35 are mirror images of one another, reference will only be made to first end 82 in detailing the manner in which first end 82 is inserted in support rail 24' and it is to be understood that second end 83 will be inserted into support rail 24 is the same manner. First end 82 of crossbar 35 is inserted into opening 58 of a selected aperture 56' and advanced into channel 45' until end wall 92 of notch 86 abuts curved end wall 80 of aperture 56'. Crossbar 35 is then tilted such that notch 87 passes over shoulder 78 and notches 86 and 87 are aligned with second slot 68. Once crossbar 35 is aligned within second slot 68, the peripheral structure about aperture 56 retains crossbar 35 at an angled position with respect to rail 24'.

Any appropriate type of hooked cantilevered shelf can now be hung on crossbar 35. In a preferred embodiment of the present invention, a pair of shelves 21 and 22 is provided wherein each shelf 21, 22 has a width which is approximately one-half the width of fresh food compartment 8. Each of shelves 21 and 22 has an external frame 100, a panel or platform 102 mounted within external frame 100, and an internal frame bar (not shown). Preferably, external frame 100 is injection molded and panel 102 is made of glass. The internal frame member includes a rolled hook portion 106 (see FIG. 2) extending from the backside of the shelf 21, 22. Preferably, hook 106 and the internal frame member have a unitary construction. Although hook 106 is shown extending the length of the shelf 21, 22, a plurality of laterally spaced hooks could be utilized. Hook 106 is configured to be placed over crossbar 35 to support the shelf 21, 22 in a cantilevered fashion. The elongated hook 106 and the sloped crossbar face 88 enhance distribution of the shelf load substantially across the width of the hook 106 and crossbar face 88.

The shelves 21, 22 can be arranged on rails 32, 33 in a number of configurations. For example, shelves 21, 22 can be mounted side-by-side on a single crossbar 35, or one shelf 21 may be mounted above the other shelf 22 in either direct alignment or laterally offset. The hook and crossbar configuration allows a shelf to be slid in either lateral direction along the crossbar such that shelves can be in any desired horizontal position within a refrigerator compartment. This provides a user with the flexibility to arrange shelving around objects within a food compartment with minimal effort.

As previously mentioned, rails 24, 24' can be attached to the inside of refrigerator cabinet 2 in any conventional manner. In a preferred embodiment, rail 24' includes a first mounting hole 120' and a second mounting hole 125'. The larger diameter of first mounting hole 120' gives a user access to second mounting hole 125' through crossbar support portion 42', thus allowing a user to attach mounting portion 38' of rail 24' to a side-wall of refrigerator cabinet 2 via a mechanical fastening member (not shown). Additional mechanical fasteners could be employed along the length of rail 24'. Of course, rail 24 can be attached to a side-wall of refrigerator cabinet 2 in a like manner via a first mounting hole (not shown) and a second mounting hole 125.

Although described with reference to a preferred embodiment of the invention, it should be readily understood that various changes and/or modifications could be made to the invention without departing from the spirit thereof. For instance, although half-width shelves are depicted for use with the shelving system of the current invention, other types of hook-type cantilevered shelves, including full-width shelves, could be utilized with the repositionable rail system of the present invention. Further, a variety of aperture configurations could be used without departing from the spirit of the invention. In general, the invention is only intended to be limited by the scope of the following claims.

I claim:

1. In a refrigerator comprising a cabinet shell and a liner disposed in the cabinet shell, the liner including opposing, fore-to-aft extending side walls and a back wall defining, at least in part, a food storage compartment, a rail system for removably supporting side sliding shelves comprising:

first and second horizontally spaced rails positioned adjacent the back wall, each of the first and second rails including a plurality of spaced-apart apertures;

a crossbar having a first end and a second end, with the first end being removably supported in a select one of the plurality of apertures of the first rail and the second end being removably supported in a select one of the plurality of apertures of the second rail wherein each of the plurality of apertures of the first and second rails is defined by first and second slots extending along intersecting axes, with the crossbar being removably supported by each of the first and second rails after being inserted into the first slot and rotated into the second slot; and a shelf having at least one hook, said shelf being removably hung upon the crossbar by the hook and extending from the crossbar in cantilevered fashion.

2. The refrigerator rail system according to claim 1, wherein the shelf has a width that is less than a length of the crossbar and the at least one hook can be slid horizontally on the crossbar to laterally re-position the shelf within the food storage compartment.

3. The refrigerator rail system according to claim 1, wherein the first rail comprises a mounting portion, a crossbar support portion and a bent portion interconnecting the mounting portion and the crossbar support portion and wherein each aperture of the plurality of apertures of the first rail extends from the bent portion to the crossbar support portion.

4. The refrigerator rail system according to claim 3, wherein the second rail comprises a mounting portion, a crossbar support portion and a bent portion interconnecting the mounting portion and the crossbar portion, and wherein each aperture of the plurality of apertures of the second rail extends from the bent portion to the crossbar support portion.

5. The refrigerator rail system according to claim 3, wherein the first rail has a substantially U-shaped cross-section defined by the mounting portion, the crossbar support portion and the bent portion, with the mounting portion extending substantially parallel to the crossbar support portion, while being spaced from the crossbar support portion by the bent portion.

6. The refrigerator rail system according to claim 5, further comprising: a flange portion projecting from the crossbar support portion at a position spaced from the bent portion.

7. The refrigerator rail system according to claim 5, further comprising: a first mounting hole formed in the mounting portion and a second mounting hole formed in the crossbar support portion, said second mounting hole being aligned with the first mounting hole.

8. The refrigerator rail system according to claim 7, wherein the second mounting hole has a larger diameter than the first mounting hole.

9. The refrigerator rail system according to claim 1, wherein the crossbar is consists of a one-piece, flat bar.

10. The refrigerator rail system according to claim 1, wherein the first and second slots are defined by a common curved end wall.

11. The refrigerator rail system according to claim 1, further comprising: a notch formed in each of the first and second ends of the crossbar, each said notch receiving a portion of a respective one of the first and second rails.

12. A method for assembling a repositionable rail system in a refrigerator having a cabinet shell and a liner disposed in the cabinet shell with the liner including opposing, fore-to-aft extending side walls and a back wall defining, at least in part, a food storage compartment comprising:

mounting first and second horizontally spaced rails, each of which includes a plurality of spaced apertures, at laterally spaced locations adjacent the back wall of the food storage compartment;

inserting a first end of a crossbar into a first one of said plurality of apertures on the first rail and inserting a second end of the crossbar into a second one of said plurality of apertures on the second rail;

rotating the crossbar within the first and second apertures such that the crossbar engages support structure on the first and second rails and is retained within the first and second apertures in a fixed, angled position; and placing a rear hook of a shelf over the crossbar so that the hook supports the shelf in a cantilevered fashion upon the crossbar.

13. The method of claim 12, further comprising: laterally repositioning the shelf within the food storage compartment by sliding the hook of the shelf along the crossbar.

14. The method of claim 12 wherein, upon inserting the first end of the crossbar into the first one of the plurality of apertures on the first rail, the crossbar extends along a first axis defined by a first slot of the first one of the plurality of apertures and, upon rotating the crossbar, the crossbar extends along a second axis defined by a second slot of the first one of the plurality of apertures.

15. The method of claim 12, further comprising: causing respective portions of the first and second rails to be received within notches, provided in first and second end portions of the crossbar, upon rotating the crossbar.

16. The method of claim 12, wherein each of the first and second rails is mounted by extending a mechanical fastener first through a first, larger hole formed in a crossbar support portion, then through a second, smaller hole formed in a crossbar mounting portion which is connected to the crossbar support portion through a bent portion, and securing the mechanical fastener to one of the side and back walls of the liner.

* * * * *